US008191391B2

(12) United States Patent
Baensch

(10) Patent No.: US 8,191,391 B2
(45) Date of Patent: Jun. 5, 2012

(54) DRIVE FOR A COLD PILGER MILL

(75) Inventor: Michael Baensch, Rheinberg (DE)

(73) Assignee: SMS Meer GmbH, Moenchengladbach (DE)

( * ) Notice: Subject to any disclaimer, the term of this patent is extended or adjusted under 35 U.S.C. 154(b) by 352 days.

(21) Appl. No.: 12/690,306

(22) Filed: Jan. 20, 2010

(65) Prior Publication Data

US 2010/0192656 A1 Aug. 5, 2010

(30) Foreign Application Priority Data

Feb. 4, 2009 (DE) ..... 10 2009 007 465

(51) Int. Cl.
*B21B 35/00* (2006.01)

(52) U.S. Cl. ..... 72/214; 72/249

(58) Field of Classification Search ..... 72/208, 72/214, 226, 234, 249, 449, 450
See application file for complete search history.

(56) References Cited

U.S. PATENT DOCUMENTS

| | | | | |
|---|---|---|---|---|
| 4,386,512 | A * | 6/1983 | Rehag et al. | 72/214 |
| 5,076,088 | A | 12/1991 | Klingen et al. | 72/214 |
| 5,540,076 | A | 7/1996 | Baensch et al. | 72/214 |
| 5,916,320 | A * | 6/1999 | Stinnertz et al. | 72/214 |
| 7,073,362 | B2 * | 7/2006 | Baensch | 72/214 |
| 7,082,799 | B2 | 8/2006 | Stinnertz et al. | 72/214 |

FOREIGN PATENT DOCUMENTS

| | | |
|---|---|---|
| DE | 962062 | 4/1957 |
| DE | 3613036 | 8/1987 |
| DE | 4336422 | 10/1996 |
| DE | 10147046 | 4/2003 |

* cited by examiner

*Primary Examiner* — David Jones
(74) *Attorney, Agent, or Firm* — Andrew Wilford

(57) ABSTRACT

A drive for a roll stand having a reciprocal frame, has a pair of substantially identical cranks rotating about respective crank axes offset from the frame, respective connecting rods pivoted on and connected between the cranks and the frame, and respective counterweight on the cranks opposite the respective arms. The cranks, rods, and counterweights flank a central plane. Respective drives rotate the cranks about the respective axes in opposite rotational directions.

11 Claims, 2 Drawing Sheets

DRIVE FOR A COLD PILGER MILL

FIELD OF THE INVENTION

The present invention relates to drive for a roll stand. More particularly this invention concerns such a drive for a stand of a cold pilger mill.

BACKGROUND OF THE INVENTION

A cold pilger rolling mill has at least one roll stand that is reciprocated horizontally by a crank drive comprising a crank arm with a counterweight for at least partially counterbalancing the mass forces generated by the roll stand. A connecting rod is pivoted on and connects the roll stand and the crank arm to one another.

A drive system of this type is known, for example, from U.S. Pat. No. 5,540,076. In order to carry out the cold pilger process, a roll stand is equipped with a cold pilger roll pair that is driven reciprocated, normally horizontally. To this end, a crank drive is used that is driven by a motor. The crank drive is provided with a counterweight in order to balance the mass forces of the roll stand with a counterweight. However, this weight is usually not enough to provide sufficient balance for the mass forces.

The productivity of a cold pilger mill is a direct function of the stroke rate of the roll stand per time unit, for which reason the greatest possible number of working strokes per minute is desired for reasons of cost effectiveness. However, this also leads to large mass forces that subject the drive system and particularly its bearing as well as the base and therefore the surroundings to a considerable load. Therefore, in the solution mentioned above, provision is made for the crank drive to drive an additional shaft on which a counterweight is eccentrically connected relative to the center of gravity via a gearing. This counterweight rotates in the opposite direction when the crank drive rotates and is thus able to generate equalizing mass forces and/or mass momentums such that an equalization of mass force results overall in the entire drive system.

In this known embodiment, it is disadvantageous that the entire drive system is quite expensive and complex because a large number of machine elements—engaged in one another via gears—are necessary. This also increases the cost of the drive system and therefore of the cold pilger mill; the increased costs include not only the investment costs for the system itself, but also costs for the system base, for replacement and expendable parts, as well as costs for maintenance and repair.

From DE 962 062 a drive system is known for a cold pilger mill in which the crank arm is equipped for driving the roll stand with flyweights and a vertically oscillating counterweight for equalizing the mass forces of the first order as well as the mass momentums in the drive. This solution has the disadvantage that the base of the roll mill has a very complex and therefore expensive structure because provision must be made for the counterweight to vertically plunge into the base. A large and deep cellar is required for this purpose, which correspondingly increases the costs for the roll mill.

U.S. Pat. No. 5,076,088 discloses a drive for the roll stand of a cold pilger mill, with a planetary crank drive being used for driving and equalization of mass forces and mass momentums. Although this solution is able to provide an optimal mass equalization, this drive is only suitable for smaller cold pilger mills because, for larger systems, the overall size of such a drive system would increase disproportionally and thus incur high costs.

U.S. Pat. No. 7,082,799 describes a drive system for a cold pilger mill that uses, in order to improve the mass force equalization, separate shafts with counterweights, these shafts being driven by a drive that is independent of the drive of the crank drive. The synchronization of the drives when the roll mill is in operation is performed electronically. However, the expense required for this system is not insignificant.

Therefore, in known drive systems for cold pilger mills, double-offset, expensive crank shafts are used that move the roll stand in an oscillating fashion via connecting rods. The counterweights on the crank shaft and on additional rotating auxiliary shafts eliminate the mass forces that ensue due to the back-and-forth movement of the roll stand.

OBJECTS OF THE INVENTION

It is therefore an object of the present invention to provide an improved drive for a cold pilger mill.

Another object is the provision of such an improved drive for a cold pilger mill that overcomes the above-given disadvantages, in particular where the mass forces, at least of the first order, can be kept as low as possible with a simplified and thus more cost-effective construction.

SUMMARY OF THE INVENTION

A drive for a roll stand having a reciprocal frame, has according to the invention a pair of substantially identical cranks rotating about respective crank axes offset from the frame, respective connecting rods pivoted on and connected between the cranks and the frame, and respective counterweight on the cranks opposite the respective arms. The cranks, rods, and counterweights flank a central plane. Respective drives rotate the cranks about the respective axes in opposite rotational directions.

Both crank drives are preferably designed in a mirror image fashion relative to the central plane, that is they symmetrically flank the central plane, which according to the invention is vertical.

The drives also symmetrically flank the plane. Each drive is at least one electric motor.

One gear train each may be disposed between the electric motor and the crank drive. In this case, a single-stage helical gear train is preferably provided as the gear train.

An alternative and additionally advantageous solution provides for the electric motor to drive the crank drive without a gear train connected therebetween. In this case, the electric motor is preferably a slow-running, high-torque motor.

The crank drive is preferably embodied as a non-set slider crank drive.

The proposed drive system is free of additional shafts with counterweights.

The masses of the counterweights are such that the frame mass forces of the first order are counterbalanced, at least to a substantial extent, preferably completely, when the drive is operating.

It is advantageous for the crank drives required to have a very simple structure. In particular, the special crank drives typically used in known drives for cold pilger mills are not necessary. In particular, double-offset crank shafts, which are complex and expensive, may be omitted.

Moreover, a separate counterbalance shaft, as is known from the prior art, may be omitted.

In addition, the entire system may have a shorter construction as well.

The drive system according to the invention renders the mechanical connection of the two crank offsets of the crank drives unnecessary. The crank drives are embodied as non-set slider crank drives; the connecting rod joint to the roll stand thus moves on a straight line that runs through the rotational axis of the crank. Both cranks are preferably driven by separate motors. The drives have rotational directions opposite one another, for which reason the mass forces of the first order may be completely counterbalanced with the counterweights on the cranks alone. An additional shaft with counterweights may be omitted provided that the cranks have opposing rotational directions.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
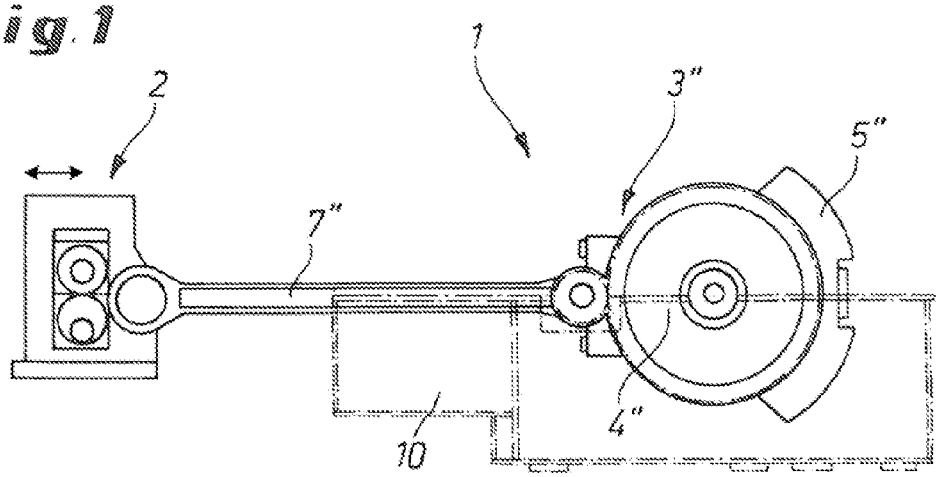
FIG. 1 is a side view in small scale of the drive and a pilger-mill stand according to the invention.
Figure 2:
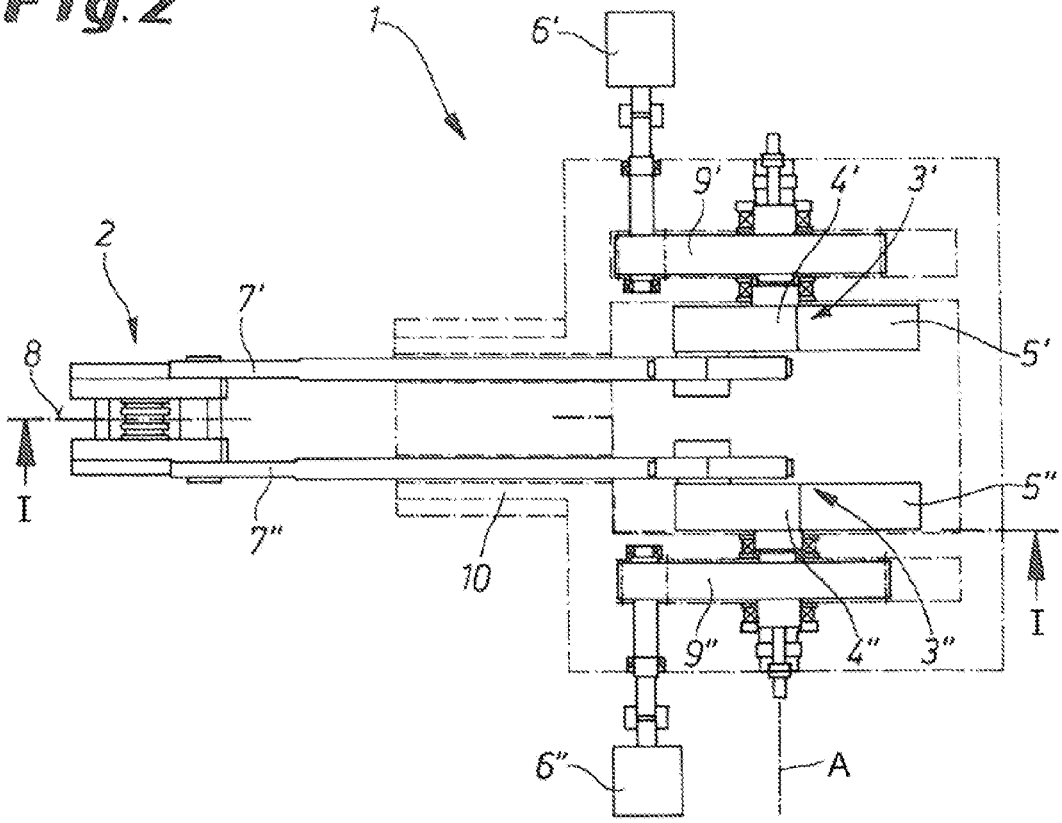
FIG. 2 is a top view of the system of FIG. 1, line I-I showing the section of FIG. 1.

As seen in FIGS. 1 and 2 a drive system 1 according to the invention serves to horizontally drive a cold pilger rolling mill of which only a roll stand 2 is shown that must reciprocate horizontally in order to perform the known cold pilger milling process for making pipe.

The roll stand 2 is driven by two substantially identical crank drives 3' and 3" carried on a common frame 10 and symmetrically flanking a vertical center plane 8 (FIG. 2). The crank drives 3' and 3" have respective a crank arms 4' and 4", counterweights 5' and 5", and connecting rods 7' and 7". These units are known per se for driving a cold pilger mill. The rods 7' and 7" have outer ends pivoted on the stand 2 and inner ends pivoted on the respective cranks 4' and 4" offset from the horizontal rotation axis A thereof. Both cranks 4' and 4" are actually semicircles that are diametrally opposite the respective counterweights 5' and 5".

Each of the parts of each drive 3' or 3" symmetrically flanks the plane 8 with the corresponding part of the other drive 3' or 3". Furthermore the drives 3' and 3" are driven by respective drive motors 6' and 6", but in opposite rotational directions. While the crank drive 3' of the one unit on the one side of the central plane 8 rotates about the axis A, for example, clockwise, the other crank drive 3" on the opposite side of the central plane 8 moves counterclockwise. The two electric motors 6' and 6" drive the crank drives 3' and 3" by respective single-stage helical gear trains 9' and 9" each, each formed by a small-diameter pinion on the output shaft for the respective motor 6' or 6" and a large-diameter gear on the shaft carrying the crank 4' or 4" and counterweight 5' or 5".

The roll stand 2 is thus reciprocated by two connecting rods 7', 7" that themselves are driven in opposite directions by the separate motors 6' and 6" via the respective crank drives 3' and 3". Mass equalization occurs in that the counterweights 5' and 5" of the crank drives 3' and 3" rotate in opposite directions. Mass forces of the first order are thus completely equalized.

Figure 3:
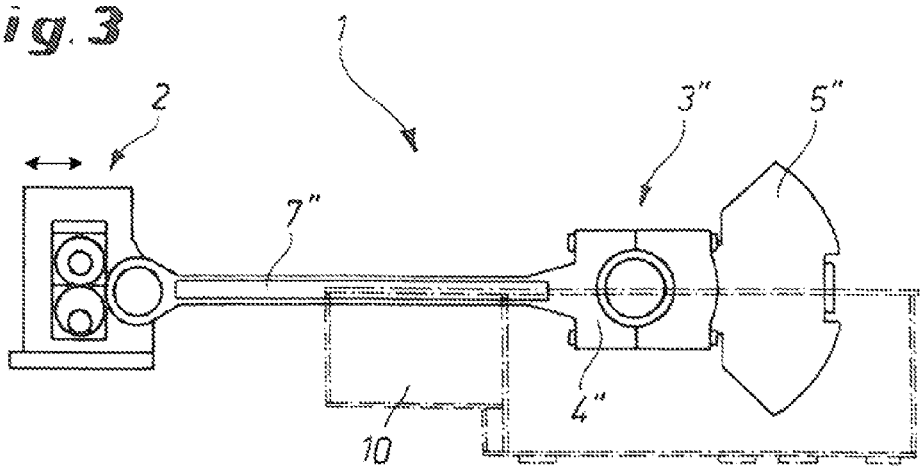
FIG. 3 is a side view like FIG. 1 of another pilger-mill stand and drive according to the invention.
Figure 4:
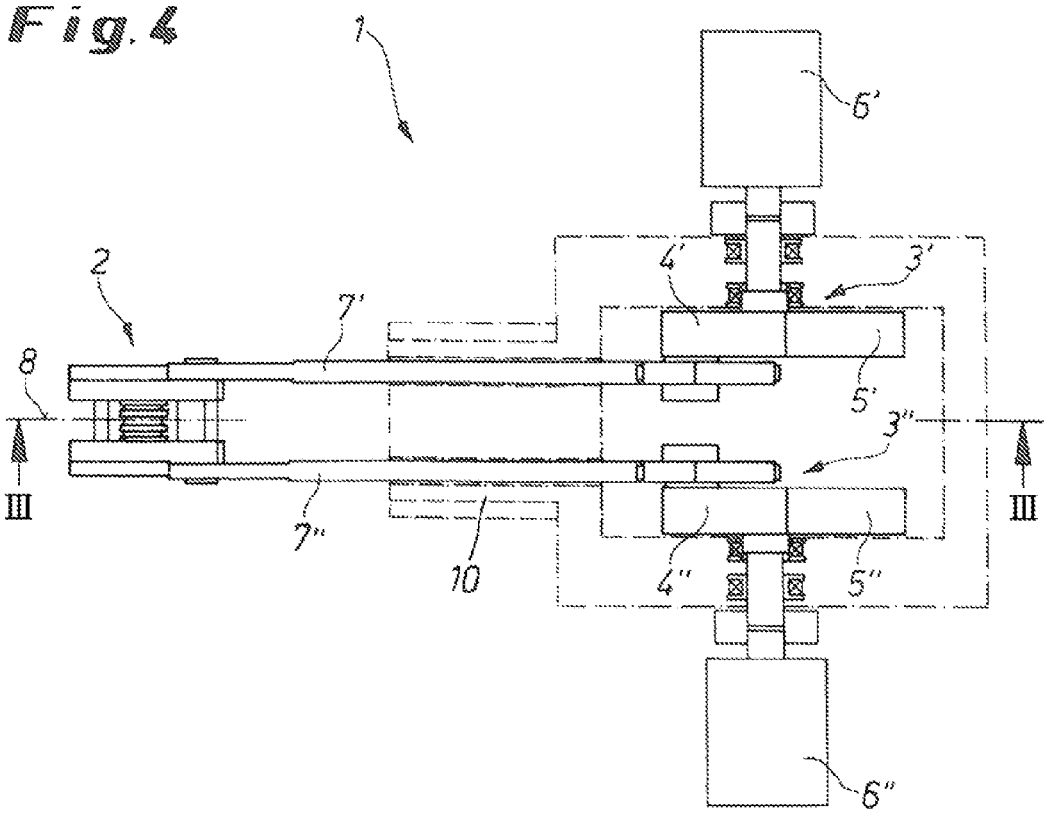
FIG. 4 is a top view of the system of FIG. 3, line showing the section of FIG. 3.

FIGS. 3 and 4 show an alternative embodiment. Here, the gear trains 9' and 9" between the motors 6' and 6" and the crank drives 3' and 3" are omitted, i.e. the crank drives 3' and 3" are driven directly by the output shaft of the motors 6' and 6". Omitting the gear trains 9' and 9" allows the advantageous use of motors that run more slowly and have higher torques. This omits gears and the corresponding gear train housing, such that an even simpler structure of the drive system is achieved.

I claim:

1. In combination with a roll stand having a reciprocal frame, a drive comprising:

a pair of substantially identical cranks rotating about respective crank axes offset from the frame;

respective connecting rods pivoted on and connected between the cranks and the frame;

respective counterweights the cranks opposite the respective arms, the cranks, rods, and counterweights flanking a central plane; and respective drives for rotating the cranks about the respective axes in opposite rotational directions.

2. The drive defined in claim 1 wherein the cranks, rods, and counterweights symmetrically flank the plane.

3. The drive defined in claim 2 wherein the crank axes are coaxial and pass perpendicularly through the plane.

4. The drive defined in claim 3 wherein the drives include respective separate motors.

5. The drive defined in claim 4 wherein the motors also symmetrically flank the plane.

6. The drive defined in claim 4 wherein the motors are electric.

7. The drive defined in claim 6, wherein each drive includes a respective gear train between the respective motor and the respective crank.

8. The drive defined in claim 7 wherein the gear trains also symmetrically flank the plane.

9. The drive defined in claim 7 wherein the gear trains are a single-stage helical-gear trains.

10. The drive defined in claim 8 wherein the electric motors are slow high-torque motors.

11. The drive defined in claim 1 wherein the counterweights are of such mass as to compensate for first-order forces of the drive.

* * * * *